US008919059B2

(12) United States Patent
Vaes et al.

(10) Patent No.: US 8,919,059 B2
(45) **Date of Patent: *Dec. 30, 2014**

(54) CROWN MOULDING

(71) Applicant: Flip Face USA, LLC, Fort Lauderdale, FL (US)

(72) Inventors: Ed Vaes, Stoney Creek (CA); John Charette, Hamilton (CA)

(73) Assignee: Flip Face USA, LLC, Fort Lauderdale, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/961,300

(22) Filed: Aug. 7, 2013

(65) Prior Publication Data

US 2013/0318899 A1 Dec. 5, 2013

Related U.S. Application Data

(63) Continuation of application No. 12/670,086, filed on Jan. 21, 2010, now Pat. No. 8,516,758.

(51) Int. Cl.
*E04B 2/00* (2006.01)
*E04F 19/04* (2006.01)

(52) U.S. Cl.
CPC ..... *E04F 19/04* (2013.01); *E04F 19/0436* (2013.01); *E04F 19/0495* (2013.01); *E04F 2019/0454* (2013.01)
USPC ..... 52/287.1; 52/288.1

(58) Field of Classification Search
USPC ..... 52/287.1, 288.1, 461, 464, 468, 716.1
See application file for complete search history.

(56) References Cited

U.S. PATENT DOCUMENTS

| | | | | |
|---|---|---|---|---|
| 3,201,910 | A * | 8/1965 | Keesee | 52/287.1 |
| 4,709,522 | A * | 12/1987 | Carnahan | 52/288.1 |
| 5,001,877 | A | 3/1991 | Edwards | |
| 5,179,811 | A | 1/1993 | Walker et al. | |
| 5,433,048 | A * | 7/1995 | Strasser | 52/288.1 |
| 5,555,688 | A * | 9/1996 | Logan | 52/288.1 |
| 5,601,912 | A * | 2/1997 | Ellingson | 428/318.6 |
| 6,379,597 | B1 * | 4/2002 | Brucker | 264/177.1 |
| 6,910,307 | B1 * | 6/2005 | Maurer | 52/287.1 |
| 6,918,977 | B1 * | 7/2005 | Maurer | 156/71 |
| 7,958,685 | B2 | 6/2011 | Rowohlt | |
| 8,516,758 | B2 * | 8/2013 | Vaes et al. | 52/287.1 |
| 2006/0196144 | A1 * | 9/2006 | Spek | 52/720.1 |
| 2008/0092470 | A1 * | 4/2008 | Jackson | 52/288.1 |

OTHER PUBLICATIONS

Certainteed Corporation, Brochure, p. 1, Sep. 2007, US.
Gossen Mouldings, Brochure, pp. 1-6, 2004, US.

(Continued)

*Primary Examiner* — Basil Katcheves
(74) *Attorney, Agent, or Firm* — Scott D. Smiley; Mark C. Johnson; The Concept Law Group, P.A.

(57) ABSTRACT

An elongated crown moulding with a front surface having a top front chamfer portion, a bottom front chamfer portion, and a front non-planar decorative profile portion separating the top front chamfer portion and the bottom front chamfer portion, and a back surface having a top back chamfer portion, a bottom back chamfer portion, and a back non-planar decorative profile portion disposed between the top back chamfer portion and the bottom back chamfer portion, the back non-planar decorative profile portion oriented as an inversely mirrored version of the front non-planar decorative profile portion.

20 Claims, 14 Drawing Sheets

(56) References Cited

OTHER PUBLICATIONS

Gossen Mouldings, Cellular PVC Millword, Brochure, p. 1-6, 2003, US.
Woodgrain Millwork, Drawings, pp. 2-3, Nov. 15, 2002, US.
Wood Moulding & Millword Producers Association, WMDF Series Wood Moulding Patterns, pp. 1-4, 7-11, 2002, US.
Wood Moulding & Millword Producers Association, WM/Series Wood Moulding Patterns, pp. 1-8, 10-11, 15, Dec. 2000, US.
Wood Moulding & Millword Producers Association, Hardwood Moulding Patterns, pp. 1, 4-13, 1991, US.
Campbellsville Industries, Inc., Stock Cornices, p. 2, 1975, US.
Author Unknown; Base Mouldings, Hardwood Accents; Product Descriptions; p. 1; (undated); Country Unknown.
Author Unknown; Rosettes & Blocks, Fluted Mouldings, Detail Mouldings, Chair Rail Mouldings, Crown Mouldings; Product Descriptions; p. 1; (undated); Country Unknown.
Author Unknown; Elements, Door Casings, A Selection of Ornamental Mouldings for Your HOme, Easitrim Miterless Installation, Cornices, Chair Rails, Baseboards, Easitrim: What you need to do; Corbels, Product Descriptions; p. 1; (undated); Country Unknown.
Author Unknown, Impressions in Wood . . . ; Product Descriptions; p. 1; (undated); Country Unknown.
Royal Mouldings, Never Rot Exterior Cellular Vinyl Mouldings; Product Descriptions; pp. 1-2; (undated); US.
Mouldings & Millwork; Profile Selection Guide; Brochure; pp. 1, 6-30; (undated); US.
Georgia-Pacific; Lawrenceville Stock Moulding Catalog; Catalog; pp. 1-14; (undated); US.
The Home Depot; Make an Impression with Moulding; Brochure; pp. 1, 9; (undated); US.
Author Unknown; Sprung Molding, Molding Profiles; Product Descriptions; pp. 1-2; (undated); US.

* cited by examiner

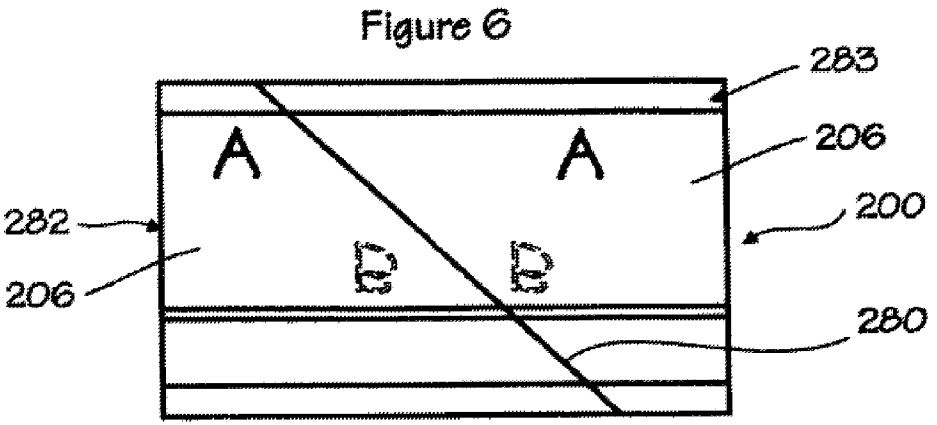
Figure 6
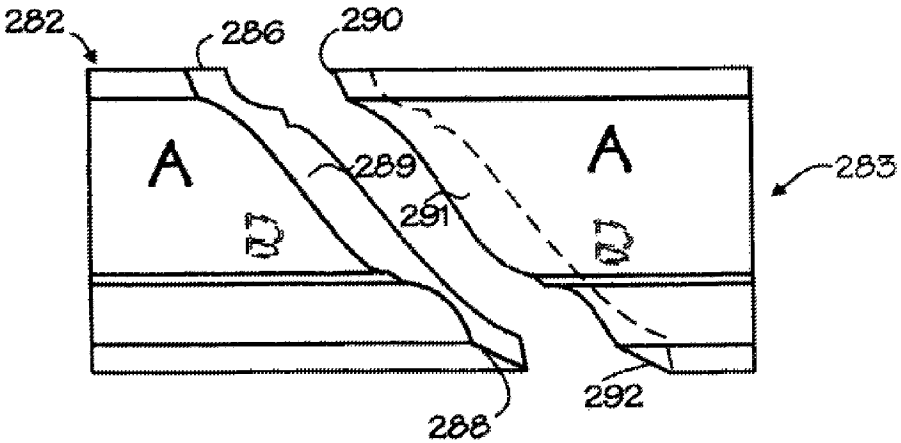
Figure 7
Figure 8

202
204
282
283
286
288
289
290
291
292
294
296
280
A
B

CROWN MOULDING

CROSS-REFERENCE TO RELATED APPLICATION

This application is a continuation of U.S. patent application Ser. No. 12/670,086 filed Jan. 21, 2010, which was a nationalized application from PCT Application No. PCT/CA2009/001762 that claims the benefit of U.S. Provisional Application No. 61/120,128 filed Dec. 5, 2008, the entirety of all are incorporated herein by reference.

FIELD OF THE INVENTION

The present invention relates to architectural moulding used in interior and exterior residence and commercial applications and, in particular, relates to lineal crown mouldings used in residential and commercial construction.

BACKGROUND OF THE INVENTION

Installing architectural moulding inside a room or to a building exterior is an increasing trend in building construction and renovation. When tastefully designed, it adds a degree of elegant decoration that enhances the esthetics of the business or residence, and potentially increases property values. Crown mouldings are typically fashioned as an elongated strip of decorative material installed at an angle at the juncture between walls and ceilings, ledges or overhanging roofing but can find other applications including capping walls, pilasters, cabinets, cornice assemblies or door and window hoods. Crown mouldings can be manufactured in a variety of materials. Historically crown mouldings were milled from wood or cast in plaster. Today crown mouldings are available in plaster, solid wood, finger joint wood construction, medium density fibreboard (MDF), polyurethane, PVC, fiberglass, polystyrene and plaster-coated foam mouldings.

Conventional lineal crown moulding is an elongated piece of material having a front surface with a decorative profile and a generally flat back surface. Crown mouldings that are cast or extruded have a front surface with a decorative profile, but the back surface is more likely to be non-planar to reduce the amount of material used to form the moulding.

Regardless of the material of construction, the entire front surface is decorative and serves no functional purpose. The crown moulding is typically applied against a ceiling and a wall at an angle. Crown moulding typically comes in three different spring angles: 38°, 45°, and 52°. The spring angle is the "tilt" at which the crown moulding sits on the wall. The different spring angles are a way to show off the moulding detail better at different wall heights. For example, on a lower ceiling you want the crown moulding to tilt up towards the eye for better viewing. In the same way crown moulding set into a high ceiling looks best when ifs tilted down.

The spring angle or tilt is accomplished by providing a top chamfer portion on the back surface which is placed against the ceiling ("ceiling seat") and a bottom chamfer portion on the back that is placed against the wall ("wall seat"). With a 38° spring angle, the moulding is tilted at an angle of 38° relative to the wall and at an angle of 52° relative to the ceiling with the wall seat flat against the wall and the ceiling seat flat against the ceiling. This provides a crown moulding mounted further down the wall.

With a 52° spring angle, the moulding is tilted at an angle of 52° relative to the wall and at an angle of 38° relative to the ceiling with the wall seat flat against the wall and the ceiling seat flat against the ceiling. This provides a crown moulding mounted further along the ceiling.

With a 45° spring angle, the moulding is tilted at an angle of 45° relative to the wall and at an angle of 45° relative to the ceiling with the wall seat flat against the wall and the ceiling seat flat against the ceiling. This provides a crown moulding mounted equi-distant down the wall and along the ceiling.

Because crown moulding is mounted at an angle between the wall and ceiling, as opposed to flat against either the wall or the ceiling, it is difficult to cut. Further installation, in a room or other space, typically, can be time consuming in order to have the mouldings fit together in or around corners or other objects as seamlessly as possible. The possibility of errors is high and there is a significant amount of waste material. When cutting crown moulding to fit an inside or outside corner, to form the angles required to install crown molding with a mitred corner, the moulding must be cut in two directions at once; first it must be beveled and second it must be mitered. There are two different methods commonly used: vertical nested or flat.

The vertical nested method can be undertaken with either a mitre saw or compound mitre saw and is applicable to crown moulding regardless of the materials of construction or design of the moulding, provided, the saw has sufficient vertical stroke to accommodate the crown vertical nested on the saw table. Large sizes of crown mouldings, where the height of the moulding precludes vertical nesting, must be cut flat. Typically wood and MDF crown moulding are cut and installed using either a mitre saw or compound mitre saw. With moulding made from materials that are easier to cut than solid hardwoods or MDF, a mitre box and hand saw can be used. With a mitre saw or hand saw and a mitre box, the blade remains perpendicular to the saw table or base of the mitre box, but the blade is positioned to cut at an angle relative to the fence of the mitre saw or back wall of the mitre box.

Cutting crown moulding flat requires a compound mitre saw and crown moulding with a flat back surface. This is particularly true for large sizes where the vertical stroke of the saw is not sufficient to permit cutting using the vertical nesting method. With a compound mitre saw not only can the blade and table be rotated horizontally relative to the fence, the vertical angle of the blade can also be adjusted.

When cutting crown moulding using the vertical nested method, the moulding is placed with the wall seat on the bottom of the back surface of the moulding resting squarely against the fence or back wall of the mitre box and with the ceiling seat on the top of the back surface of the moulding resting squarely on the base of the saw or mitre box. Placing the moulding on the saw at the same angle as it will be installed creates the right bevel. To cut the crown moulding to create the mitre to fit an inside mitred corner, for the left side of the corner, set the saw angled to the right to half the exact angle of the first corner, schematically illustrated as \. Whether cutting for an inside or outside corner, few rooms have a perfectly square corner. In order to quickly find the exact degree of the corner, use an angle finder is required.

Save the piece of moulding to the right of the saw—the piece to the left of the saw is scrap. For the right side of the corner, reset the saw angled to the left to half the exact angle of the first corner, schematically illustrated as /. Save the piece of moulding to the left of the saw—the piece to the right of the saw is scrap.

To cut the crown moulding to fit an outside mitred corner, for the left side of the corner, set the saw angled to the left to half the exact angle of the first corner, schematically illustrated as /. Save the piece of moulding to the right of the saw—the piece to the left of the saw is scrap. For the right side of the corner, reset the saw angled to the right to half the exact angle of the first corner, schematically illustrated as \. Save the piece of moulding to the left of the saw—the piece to the right of the saw is scrap. Holding the moulding in place consistently at the proper angle while cutting can be difficult and various jigs have been developed to try and make it easier. If the two mitre cuts are off slightly the two pieces of moulding will not form a perfect mitred corner.

A compound mitre saw makes it possible to make the bevel and mitre cuts at the same time with the flat back surface of the crown moulding lying flat on the saw table. The angles for crown mouldings are very precise and difficult to set exactly. Since the mouldings can shift slightly and very few rooms have perfectly square corners, typically all saw settings are first tested on scrap pieces. Charts have been developed providing appropriate mitre-bevel settings for mouldings with 52°/38°, 38°/52°, and 45°/45° ceiling to wall seat angles for a wide range of corner angles. For example:

| | 52°/38° Crown Moulding | | 45°/45° Crown Moulding | |
|---|---|---|---|---|
| Angle between walls | Mitre Setting | Bevel Setting | Mitre Setting | Bevel Setting |
| 86 | 33.43 | 35.19 | 37.17 | 31.14 |
| 87 | 32.97 | 34.86 | 36.69 | 30.86 |
| 88 | 32.52 | 34.53 | 36.21 | 30.57 |
| 89 | 32.07 | 34.20 | 35.74 | 30.29 |
| 90 | 31.62 | 33.86 | 35.26 | 30.00 |
| 91 | 31.17 | 33.53 | 34.79 | 29.71 |
| 92 | 30.73 | 33.19 | 34.33 | 29.42 |
| 93 | 30.30 | 32.85 | 33.86 | 29.13 |

To cut the crown moulding to create the mitre to fit an inside mitred corner, using crown moulding with a spring angle of 52°/38°, for the left side of the corner, place the moulding with the back side flat against the table and the top edge of the moulding against the fence. Check the charts for a 90° corner (or other angle for the corner as measured) and set the mitre angle of the saw blade to the right, schematically illustrated as \, at 31.62° and the bevel angle at 33.86°. The piece to the left of the saw is the good piece the piece to the right of the cut is scrap. For the right side of the corner, place the moulding with the back side flat against the table and the bottom edge of the moulding against the fence. Re-set the mitre angle of the saw blade to the left, schematically illustrated as/at 31.62° and the bevel angle at 33.86°. The piece to the left of the saw is the good piece, the piece to the right of the cut is scrap. Trying to cut the moulding face down is problematic with a non-planar profile that has uneven thicknesses and may have a tendency to rock.

To cut the crown moulding to fit an outside mitred corner, for the left side of the corner, place the moulding with the back side flat against the table and the bottom edge of the moulding against the fence. Check the charts for a 90° corner and set the mitre angle of the saw to the left, schematically illustrated as/at 31.62° and the bevel angle at 33.86°. The piece to the right of the saw is the good piece the piece to the left of the cut is scrap. For the right side of the corner, place the moulding with the back side flat against the table and the top edge of the moulding against the fence. Re-set the mitre angle of the saw blade to the right, schematically illustrated as \ at 31.62° and the bevel angle at 33.86°. The piece to the right of the saw blade is the good piece the piece to the left of the cut is scrap.

For moulding with a different spring angle or for corners other than 90°, the mitre angles and bevel angles will be different.

From the foregoing it is evident that cutting and installing crown moulding takes considerable skill. In some cases a jig may be required. Further it is time consuming to set the saw, measure, cut a piece, re-set the saw, measure and cut a second piece to finish one corner. In addition there is a significant amount of waste as only the piece on one side of the saw blade after each cut can be used and the piece on the other side of the saw blade is scrap. Also the frequency of an error in setting the saw and cutting the piece for one side of the corner is relatively high resulting in additional waste of time and materials.

To avoid having to mitre-cut the crown moulding to fit precisely into inside corners or around outside corners, pre-mitred corners have been manufactured to fit a 90° inside corner or outside corner. The pre-mitred corners are made from short sections of crown moulding, usually about six to eight inches and are made with the most common profiles. By installing the pre-mitred corners in the room the installer then only has to cut the crown moulding to the correct length to butt up against the ends of the pre-mitred corners. It is important that the profile on the pre-mitred corners match exactly the profile of the lineal crown moulding. The Wood Moulding & Millwork Producers Association have standardized a number of different profiles and different sizes.

A difficulty in practical terms is that most rooms consist of inside corners, rather than outside corners. With pre-mitred corners two SKUs are required per profile and size of moulding, one for inside corners and a second for the outside corners. About 4 to 5 inside corners are sold for every outside corner. Therefore there is an extensive amount of additional shelf or bin space required for two SKUs and an extensive amount of waste of outside corners which eventually cannot be sold and are scraped. In addition the pre-mitred corners are commonly made for 90° inside corners or outside corners. But as noted above most rooms are not perfectly square with 90° corners. In situations where the corners are not 90° use of pre-mitred corners is precluded.

Another way to avoid having to cut mitred corners involves the use of corner boxes. Corner boxes have a decorative and functional purpose. One type of corner box to fit an inside corner has two flat pieces of material joined at their ends to form a right angle. The pieces are wider than the height of the crown moulding so when the top edge of the flat pieces rests against the ceiling, the end of the crown moulding butts against the flat piece. A decorative element depends from the bottom side of the flat pieces. The decorative element is typically formed of pieces of flat back crown moulding formed as an outside corner but do not have to match the profile of the crown moulding being installed. Alternatively the corner block can be made of one solid piece of material. The corner blocks for an outside corner are a notched square box larger than the height of the crown moulding so when the top edge of the box rests against the ceiling, the end of the crown moulding butts against the flat side of the box. A decorative element depends from the bottom of the box. The decorative element is typically formed of pieces of flat back crown moulding formed as outside corners but do not have to match the profile of the crown moulding being installed. Alternatively the corner block can be made of one solid piece of material. Use of the corner blocks eliminates the need to make mitred inside or outside corners when installing the crown moulding.

In an effort to make cutting the crown moulding easier numerous jigs to hold the crown moulding in position on the saw have been developed. See for example U.S. Pat. Nos. 7,360,476; 6,782,782; 6,422,117; 5,730,434; 4,907,482; and 4,875,399.

The invention described herein provides a solution to the difficulty in cutting and installing crown moulding and doing so in less time and with less waste than with products currently available.

SUMMARY OF THE INVENTION

The present invention provides lineal crown mouldings for use in residential and commercial applications that can be used to create mitred corners by setting the saw once, cutting once to form both the required beveled and mitred cut. The two pieces on opposite sides of the cut can be joined to form either an inside or outside corner or where a longer piece of moulding is required, another piece of the lineal crown moulding cut without re-setting the saw and joined with the first piece to form either an inside or outside corner.

The lineal crown mouldings of the present invention comprise an elongated moulding with a front surface having a top front chamfer portion, a bottom front chamfer portion and a front non-planar decorative profile portion positioned between said top front chamfer portion and said bottom front chamfer portion and a back surface having a top back chamfer portion and a bottom back chamfer portion and a back non-planar decorative profile portion positioned between said top back chamfer portion and said bottom chamfer portion. The front surface and the back surface have substantially identical configurations inverted relative to each other about a vertical centre line from a top edge of said crown moulding to a bottom edge of said crown moulding.

The lineal crown moulding of the present invention has a uniform cross-section along its length, the cross section having an upper half and a lower half having substantially identical configurations reversed 180 degrees relative to each other about a horizontal centre line through a mid point of said cross section.

In another aspect the present invention provides a method of cutting with a mitre saw the lineal crown moulding of the present invention to create either an inside or outside corner with one cut.

In another feature of the present invention, the back non-planar decorative profile portion oriented as an inversely mirrored version of the front non-planar decorative profile portion or the back surface is an inversely mirrored version of the front surface. Further, as shown in FIG. 5, the back non-planar decorative profile portion may be mirrored with respect to a vertical centre line that is defined by an edge located on a first portion of the moulding and an edge located on a third portion of the moulding, the vertical centre line passing through a cross-sectional centroid of the moulding.

In yet another feature of the present invention, the top front chamfer portion and the bottom back chamfer portion are substantially parallel to one another or are proportionately of a same size, as shown in FIG. 5.

In an additional feature of the present invention, the back non-planar decorative profile portion has a substantially identical contour of the front non-planar decorative profile portion.

In a further feature of the present invention, the elongated moulding is of a single piece of material.

In yet another feature of the present invention, the back non-planar decorative profile portion of the moulding has the substantially identical contour of the front non-planar decorative profile portion, yet is inversely symmetrical. The profile portion may also be symmetrical with respect to the above-described centre line.

As further described herein, a further feature of the present invention includes the moulding having a first position with the top back chamfer portion adjacent to the ceiling and the bottom back chamfer portion adjacent to the wall, the first position only exposing the front non-planar decorative profile portion. The moulding also has a second position with the top front chamfer portion adjacent to the wall and the bottom front chamfer portion adjacent to the ceiling and only exposing the back non-planar decorative profile portion that matches the profile of the front non-planar decorative profile portion when in the first position.

In a further aspect the present invention provides a method of installation of the lineal crown moulding of the present invention in less time and with less waste than conventional crown moulding.

For the purposes of this specification the term "lineal crown moulding" means a long, generally straight piece of decorative moulding as opposed to curved mouldings such as arches, corner blocks, plinth blocks, rosettes etc. The terms "top," "bottom," "upper," "lower," "front," "back," and "height" used in conjunction with the description of the crown moulding of the present invention are referenced to crown moulding orientated with its longitudinal axis horizontal.

Further features of the invention will be described or will become apparent in the course of the following detailed description.

In accordance with another feature, the present invention includes an elongated crown moulding with a front surface having a top front chamfer portion, a bottom front chamfer portion, and a front non-planar decorative profile portion disposed between the top front chamfer portion and the bottom front chamfer portion. The elongated crown moulding also includes a back surface with a top back chamfer portion, a bottom back chamfer portion, and a back non-planar decorative profile portion disposed between the top back chamfer portion and the bottom back chamfer portion, the back non-planar decorative profile portion oriented as an inversely mirrored version of the front non-planar decorative profile portion.

In accordance with another feature, the back surface is an inversely mirrored version of the front surface.

In accordance with yet another feature, the top front chamfer portion and the bottom back chamfer portion define planes that are substantially parallel to one another In accordance with a further feature of the present invention, the top front chamfer portion and the bottom back chamfer portion are proportionately of a same size.

In accordance with another feature, the back non-planar decorative profile portion has a substantially identical contour of the front non-planar decorative profile portion.

In accordance with a further, the back non-planar decorative profile portion and the front non-planar profile portion are inversely mirrored versions of each other with respect to a longitudinal centre line.

In accordance with another exemplary feature of the present invention, the longitudinal centre line is defined by an edge located on at least one of the top front chamfer portion and the top back chamfer portion of the elongated moulding and an edge located on at least one of the bottom front chamfer portion and the bottom back chamfer portion of the elongated moulding, the longitudinal centre line passing through a cross-sectional centroid of the moulding.

In accordance with another feature, the elongated crown moulding is of a single piece of homogenous material.

In accordance with the present invention, the decorative building structure includes a building having a ceiling and a wall, an elongated moulding with a front surface with a top front chamfer portion, a bottom front chamfer portion, and a front non-planar decorative profile portion disposed between the top front chamfer portion and the bottom front chamfer portion, and a back surface with a top back chamfer portion, a bottom back chamfer portion, and a back non-planar decorative profile portion disposed between the top back chamfer portion and the bottom back chamfer portion. The decorative building structure also includes a first position with the top back chamfer portion adjacent to the ceiling and the bottom back chamfer portion adjacent to the wall, the first position only exposing the front non-planar decorative profile portion and a second position with the top front chamfer portion adjacent to the wall and the bottom front chamfer portion adjacent to the ceiling and only exposing the back non-planar decorative profile portion that has the same appearance and orientation as the profile of the front non-planar decorative profile portion when in the first position.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

BRIEF DESCRIPTION OF THE DRAWINGS

In order that the invention may be more clearly understood, embodiments thereof will now be described in detail by way of example, with reference to the accompanying drawings, in which:

FIG. 6 is a front plan view of the front surface of a short piece of the lineal crown moulding of FIG. 3 showing a mitre and bevel cut with the front surface denoted as A and the back surface denoted as B;

FIG. 7 is a left piece portion of the crown moulding of FIG. 6 mitred and cut away from the right piece shown in FIG. 8;

FIG. 8 is a right piece portion of the crown moulding of FIG. 6 mitred and cut away from the left piece shown in FIG. 7;

Figure 1:
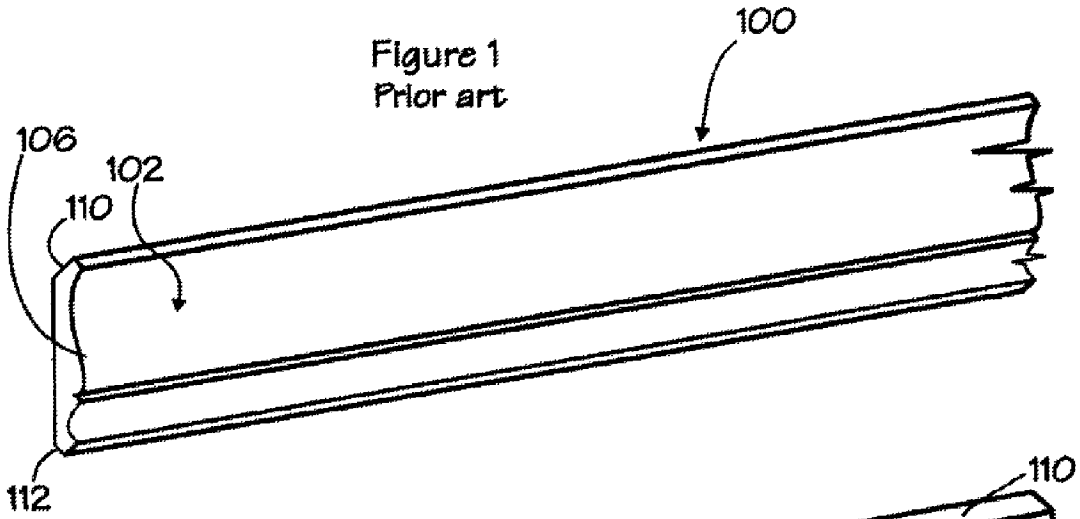
Figure 1 Prior art
FIG. 1 is a front perspective schematic of a prior art lineal crown moulding having a front surface with a decorative profile and a generally flat back surface.

It will be appreciated that for purposes of clarity and where deemed appropriate, reference numerals have been repeated in figures to indicate corresponding features, and that the various elements in the drawings have not necessarily been drawn to scale in order to better show the features of the invention.

DETAILED DESCRIPTION

Figure 2:
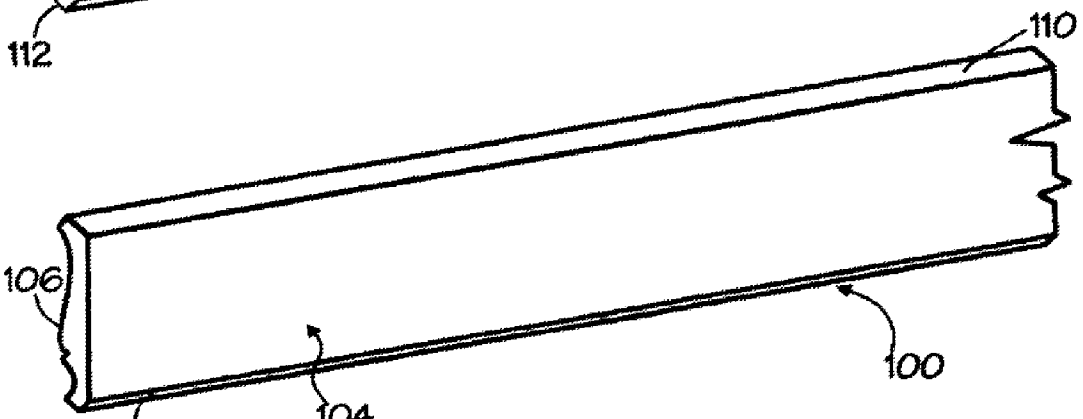
Figure 2 Prior art
FIG. 2 is a back perspective schematic of the prior art lineal crown moulding shown in FIG. 1.

Referring to FIGS. 1 and 2, prior art lineal crown moulding made from wood or MDF, generally indicated at 100, is illustrated. The crown moulding 100 has a front surface 102 with a decorative non-planar profile, generally indicated at 106 and a generally flat back surface 104. As noted above the entire front surface is decorative and serves no functional purpose. The crown moulding is typically applied against a ceiling and a wall at an angle. Crown moulding typically comes in three different spring angles, 38°, 45° and 52°. The spring angle is the "tilt" at which the crown moulding sits on the wall. The different spring angles are a way to show off the moulding detail better at different wall heights. For example on a lower ceiling you want the crown moulding to tilt up towards the eye for better viewing. In the same way crown moulding set into a high ceiling looks best when ifs tilted down.

The spring angle or tilt is accomplished by providing a top chamfer portion 110 on the flat back surface 104 which is placed against the ceiling ("ceiling seat") and a bottom chamfer portion 112 on the back surface that is placed against the wall ("wall seat"). With a 38° spring angle, the flat back surface 104 of the moulding is tilted at an angle of 38° relative to the wall and at an angle of 52° relative to the ceiling with the wall seat 112 flat against the wall and the ceiling seat 110 flat against the ceiling.

Crown mouldings may be manufactured from plaster, solid wood, finger joint wood construction. medium density fibre board (MDF), polyurethane, PVC, fiberglass, polystyrene and plaster-coated foam mouldings in a wide variety of sizes from small sizes about an inch high to about seven inches to larger sizes (custom profiles can be any height) and profiles. See for example "WM/Series Wood Moulding Patterns," "HWM/Series Hardwood Moulding Patterns," and "WMDF Series Wood Moulding Patterns," all published by the Wood Moulding & Millwork Producers Association, which describes standard profiles for flat back lineal crown mouldings made from wood or MDF and are incorporated herein by reference.

Figure 3:
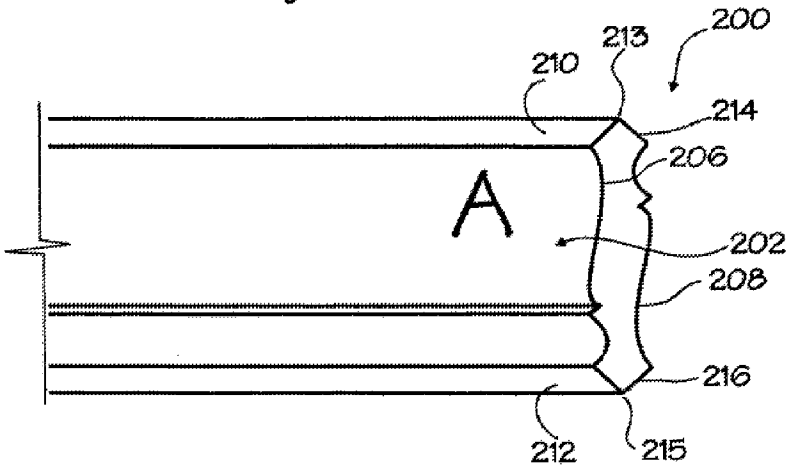
FIG. 3 is a front perspective view of one embodiment of the lineal crown moulding of the present invention having a front surface with a decorative front profile portion and having a back surface with a decorative back profile portion with the decorative front profile portion and decorative back profile portion having substantially identical configurations inverted relative to each other about a vertical centre line of the crown moulding.
Figure 4:
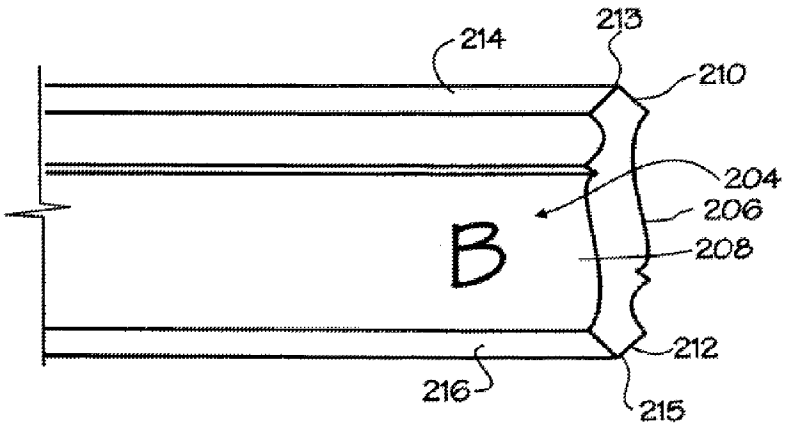
FIG. 4 is a back perspective view of the lineal crown moulding of FIG. 3.
Figure 5:
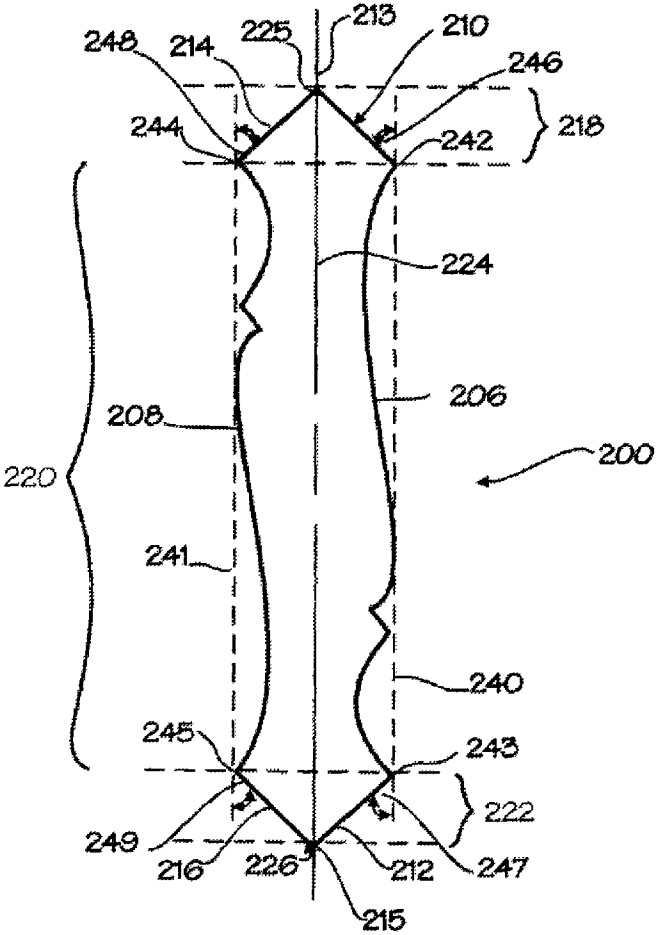
FIG. 5 is an enlarged cross sectional view of the lineal crown moulding of FIGS. 3 and 4.

Referring to FIGS. 3 to 5, one embodiment of a lineal crown moulding, generally indicated at 200, according to the present invention is illustrated. FIGS. 3 and 4 illustrate an end of the lineal crown moulding of indefinite length. As shown in FIGS. 3-5, the lineal crown moulding 200 includes a front surface 202, a back surface 204, a front decorative profile portion 206, a back decorative profile portion 208, a top front chamfer 210, a bottom front chamfer 212, a top back chamfer 214 and a bottom back chamfer 216. In FIGS. 3 and 4, the front surface 202 is denoted with the letter A and the back surface 204 is denoted with the letter B for future cross referencing.

Referring now to FIG. 5, an enlarged cross-section of the lineal crown moulding of FIGS. 3 and 4 is shown in one embodiment. As illustrated, the lineal crown moulding 200 has three distinct portions: (1) a first portion generally indicated at 218 includes the top front chamfer 210, as well as the top back chamfer 214, (2) a second portion 220 which includes the front decorative profile portion 206 and the back decorative profile portion 208 and (3) a third portion 222 which includes the bottom front chamfer 212 and the bottom back chamfer 216.

The front surface 202 and the back surface 204 of the crown moulding 200 of the embodiment shown in FIGS. 3-5 have substantially identical configurations but are not mirror images of each other. The configuration of the front surface 202 and back surface 204 are inverted (rotated 180 degrees) relative to each other about a vertical centre line 224 from a top edge 225 of said crown moulding to a bottom edge 226 of said crown moulding in order to be able to utilize both sides of the crown and obtain the mitring advantages as described herein. In the embodiment illustrated in FIG. 5, the vertical centre line 224 runs from the point of intersection 213 of the top front chamfer 210 and top back chamfer 214 to the point of intersection 215 of the bottom front chamfer 212 and bottom back chamfer 216.

The lineal crown moulding of the present invention has a uniform cross-section along its length, the cross section having an upper half and a lower half having substantially identical configurations reversed 180 degrees relative to each other about a horizontal centre line through a midpoint of said cross section.

Crown moulding 200 is useful when there is a non-planar decorative profile portion defined by the crown moulding 200 which is pleasing to the eye. The present device has no significance if, for example, the crown moulding is simply a rectangular piece of moulding where there is non-planar decorative profile portion. The present invention has a decorative profile portion 220 that is non-planar, meaning that there is a decorative contour with one or more curved sections defined within the non-planar decorative profile portion 220 which in fact is other than simply straight parallel sides as, for example, in a simple four sided dressed piece of lumber.

The crown moulding 200 of the present invention is of indefinite length and is normally referred to as lineal crown moulding which will be sold/purchased in pre-selected lengths such as 8, 12, 14, 16 and, at times, 20 foot lengths not dissimilar to the lengths of flat back crown moulding that has been previously available.

Figure 12:
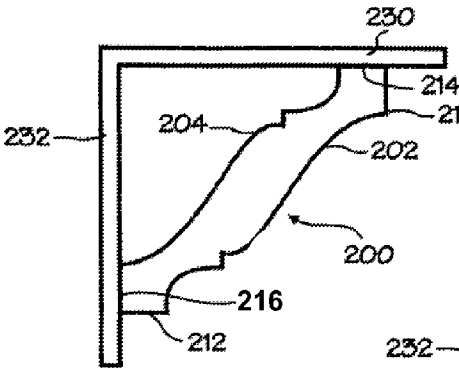
FIG. 12 is a cross sectional view of the lineal crown moulding shown deployed at the intersection of the ceiling and wall at an angle of 45 degrees with the front surface facing away from the wall and ceiling.

The lineal crown moulding 200 is shown deployed in FIG. 12 with the top back chamfer 214 on the back surface 204 adjacent ceiling 230 and the bottom back chamfer 216 on the back surface 204 adjacent wall 232. The top and bottom back chamfers 214, 216 act as landings or mounting areas upon which the lineal crown moulding 200 rests and is positioned against the wall and ceiling. In FIG. 12 the decorative front profile 206 is facing away from the wall 232 and ceiling 230. The top back chamfer 214 acts as the ceiling seat and the bottom back chamfer 216 acts as the wall seat.

Figure 13:
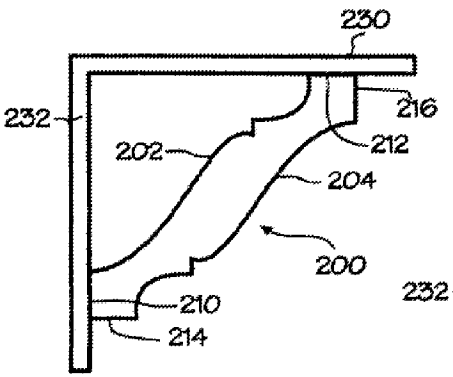
FIG. 13 is a cross sectional view of the lineal crown moulding shown deployed at the intersection of the ceiling and wall at an angle of 45 degrees turned around and inverted with the back surface facing away front the wall and ceiling.
Figure 15:
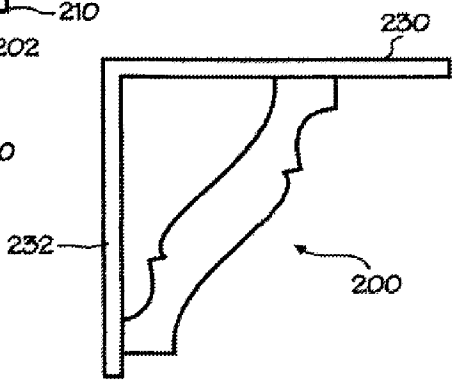
FIG. 15 is a cross sectional view of the lineal crown moulding shown deployed at the intersection of the ceiling and wall at an angle of 52 degrees to the ceiling and 38 degrees to the wall with the front surface facing away from the wall and ceiling.
Figure 14:
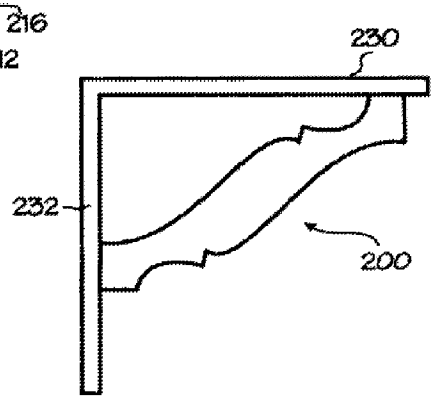
FIG. 14 is a cross sectional view of the lineal crown moulding shown deployed at the intersection of the ceiling and wall at an angle of 38 degrees to the ceiling and 52 degrees to the wall with the front surface facing away from the wall and ceiling.

Due to the configuration of the lineal crown moulding 200 of the present invention, in FIG. 13, the lineal crown moulding 200 is turned over and inverted end to end with decorative back profile 208 facing away from the wall 232 and ceiling 230. The bottom front chamfer 212 acts as the ceiling seat and the top front chamfer 210 acts as the wall seat.

The crown moulding of the present invention can be installed with either the front surface 202 being exposed and visible or the back surface 204 being exposed and visible. Regardless of the side chosen, crown moulding 200 can be selected to provide the same appearance.

As shown in FIG. 12, the crown moulding 200 installed with the front surface 202 exposed results in top back chamfer 214 and the bottom back chamfer 216 making contact with the ceiling and wall respectively. As shown in FIG. 13, the crown moulding 200 installed with the back surface 204 exposed results in bottom front chamfer 212 and the top front chamfer 210 making contact with the ceiling and wall respectively. The spring angle of the lineal crown moulding 200 of the present invention (the angular relationship of the lineal crown moulding 200 relative to the wall or ceiling) is determined by the slope of chamfers 210, 212, 214, and 216. The lineal crown moulding of the present invention installed at the juncture of a ceiling and a wall at the same common spring angles as for the prior art flat back lineal mouldings are shown in FIGS. 12-15.

If a spring angle of 45 degrees is desired each of the chamfers 210,212,214 and 216 are at an angle of 45 degrees to the straight lines 240, 241 through the two outermost points on the decorative front and back profiles 206, 208 respectively. A line through the two outermost points on the decorative front and back profiles 206, 208 is used in order the have the proper spring angle when the lineal crown moulding is cut flat (as described subsequently in this text).

For example, in FIG. 5, the line 240 is formed by the straight line through end points 242, 243 of the top front chamfer 210 and bottom front chamfer 212. The angle 246 of the top front chamfer 210 to line 240 is 45 degrees. Similarly the angle 247 of the bottom front chamfer 212 to line 240 is 45 degrees. The angle 248 of the top back chamfer 214 to line 241 is 45 degrees. Similarly the angle 249 of the bottom back chamfer 216 to line 241 is 45 degrees.

Figure 16:
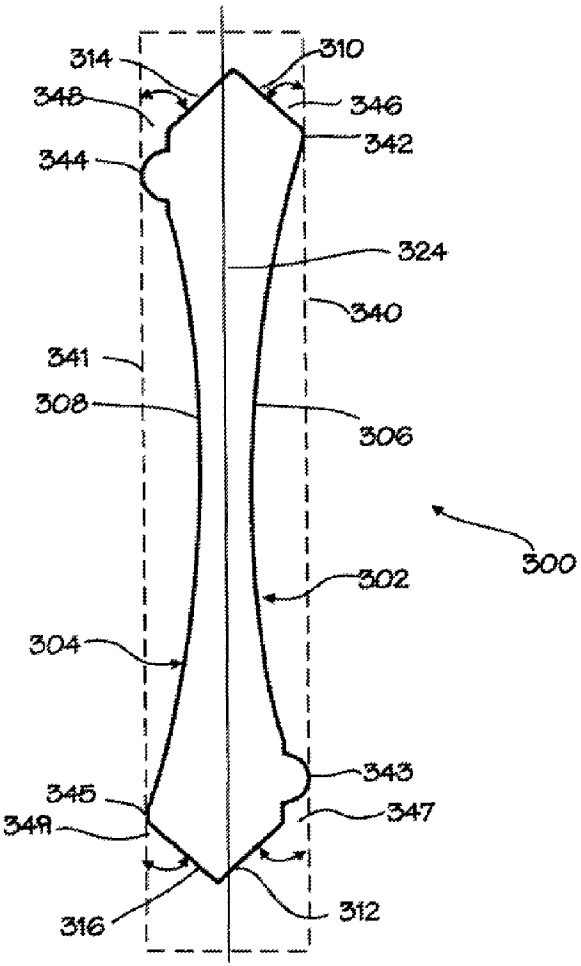
FIG. 16 is an end plan view of another embodiment of a lineal crown moulding according to the present invention having a front surface with a decorative front profile portion and having a back surface with a decorative back profile portion with the decorative front profile portion and decorative back profile portion having substantially identical configurations inverted relative to each other about a vertical centre line of the crown moulding.

In another embodiment of the lineal crown moulding 300, shown in FIG. 16, a different profile for the front surface 302 and back surface 304 is illustrated. In this embodiment, the lineal crown moulding 300 includes a front surface 302, a back surface 304, a front decorative profile portion 306, a back decorative profile portion 308, a top front chamfer 310, a bottom front chamfer 312, a top back chamfer 314 and a bottom back chamfer 316. The front surface 302 and the back surface 304 of the crown moulding 300 of the embodiment shown in FIG. 16 have substantially identical configurations inverted relative to each other about a vertical centre line 324 of said crown moulding in order to be able to utilize both sides of the crown and obtain the mitring advantages as described herein. In the embodiment illustrated in FIG. 16, the vertical centre line 324 runs parallel and midway between straight lines 340, 341 created by the two outermost points 342, 343 and 344, 345 on front and back surfaces 302, 304 respectively. The angle 346 of the top front chamfer 310 to line 340 is 45 degrees. Similarly the angle 347 of the bottom front chamfer 312 to line 340 is 45 degrees. The angle 348 of the top back chamfer 314 to line 341 is 45 degrees. Similarly the angle 349 of the bottom back chamfer 316 to line 341 is 45 degrees.

There are other orientations used and some of these are listed as follows:

| Angle to Ceiling | Angle to Wall |
|---|---|
| 38 degrees | 52 degrees (see FIG. 14) |
| 52 degrees | 38 degrees (see FIG. 15) |
| 30 degrees | 60 degrees (not shown) |
| 60 degrees | 30 degrees (not shown) |

In FIG. 5, the angles 248, 249 add up to substantially 90 degrees as do the angles 246, 247 for installation between a perpendicularly oriented wall and ceiling. The two angles 248, 247 must be substantially the same in order to be able to orient the lineal crown moulding with either the front surface 202 or back surface 204 exposed and obtain the mitring advantages as described herein. The two angles 246, 249 must also be substantially the same in order to be able to orient the lineal crown moulding with either the front surface 202 or back surface 204 exposed and obtain the mitring advantages as described herein.

The top front chamfer 210, the bottom front chamfer 212, the top back chamfer 214, and the bottom back chamfer 216 are required in order to ensure the proper orientation of the lineal crown moulding 200 against a ceiling 230 and wall 232 as depicted in FIGS. 12-13. These are not decorative features but rather structural elements required to obtain the advantages of the current invention.

Forming Mitred Inside or Outside Corners

An advantage of the lineal crown moulding of the present invention is that an inside or outside corner can be created with one cut, without the need to reset the position of the saw or cutting multiple pieces of moulding.

Referring now to FIGS. 6 through 11, we will now describe how inside and outside corners are created.

FIG. 6 illustrates a piece of lineal crown moulding according to the present cut in two directions at once; beveled and mitered. There are two different methods described hereafter for cutting the lineal crown moulding either vertical nested or flat to create the required cut. FIG. 6 shows the piece of crown moulding with the profile of the embodiment depicted in FIGS. 3-5 and having a definite length.

Figures 9, 10, 11:
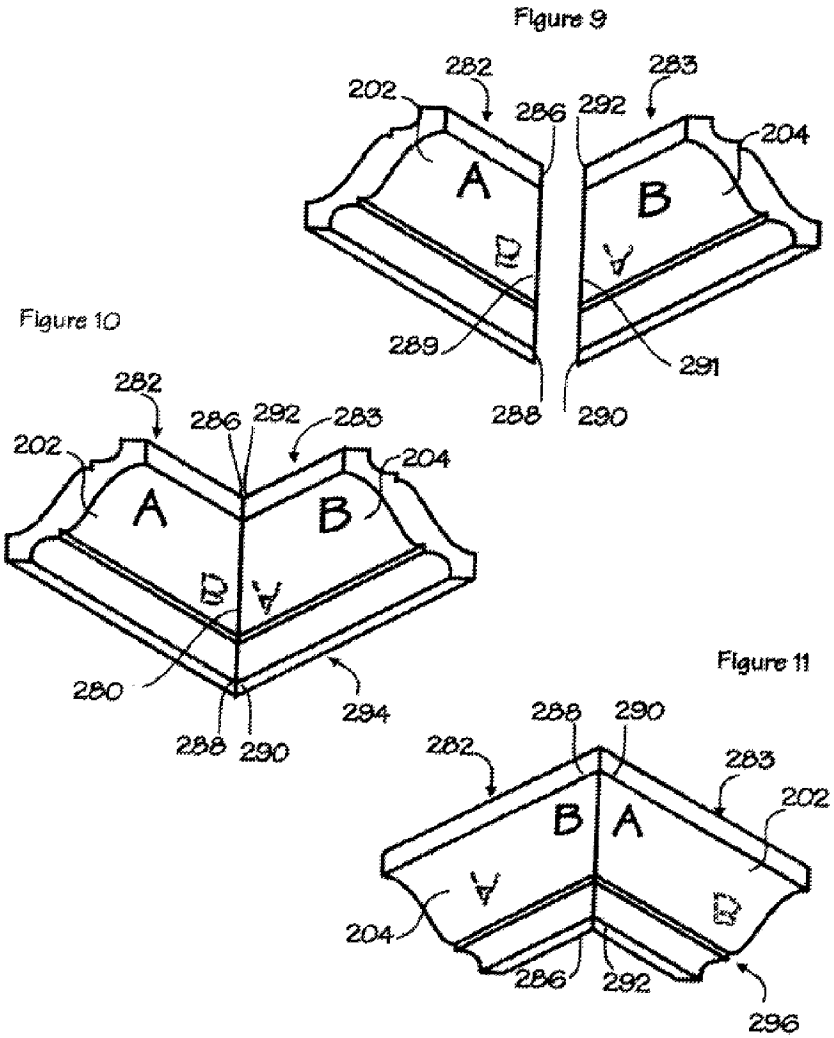
FIG. 9 shows in perspective view the left piece of the crown moulding shown in FIG. 7 in the process of being assembled to the right piece of the crown moulding shown in FIG. 8 along the mitre cut to form an inside corner shown in FIG. 10 and/or the outside corner shown in FIG. 11.
FIG. 10 is a perspective view of the left piece and the right piece of the crown moulding of the present invention assembled to form an inside corner.
FIG. 11 is a perspective view of the inside corner of FIG. 10 turned over to form an outside corner.

In FIGS. 6-11, the front surface 202 of the piece of lineal crown moulding is denoted with capital A's whereas the back surface 204 is denoted with capital B's (in dashed lines in FIG. 6 indicating that this is on the back side not seen in the top plan view of FIG. 6). The piece of lineal crown moulding is mitre and bevel cut along line 280 as shown to create a left piece 282 depicted in FIG. 7 and a right piece 283 depicted in FIG. 8. In the case where we are making component parts such as an inside corner and an outside corner, left piece 282 has a predetermined length as shown in FIG. 7 and right piece 283 has a predetermined length as shown in FIG. 8. The same technique applies to pieces of lineal crown moulding, wherein a left piece 282 has an indefinite length extending out to the left from what is shown in FIGS. 6 and 7 and right piece 283 is also of indefinite length extending to the right, outward from what is shown in FIGS. 6 and 8. Left piece 282 includes a top right edge 286 and a bottom right edge 288. The right piece 283 includes a top left edge 290 and a bottom left edge 292. In order to produce an inside corner as shown in FIGS. 9 and 10 for example, right piece 283 is inverted or turned over 180 degrees such that the back surface 204 is now visible and denoted with a solid capital B. The mitred ends 289, 291 of the left and right pieces 282, 283 are butted such that the top right edge 286 of left piece 282 is adjacent the bottom left edge 292 of right piece 283 and the bottom right edge 288 of left piece 282 is adjacent the top left edge 290 of right piece 283. This creates the inside corner shown in FIG. 10 denoted as 294.

Referring now to FIG. 11, the part depicted in FIG. 11 is an outside corner 296 which is the same part as inside corner 294 but simply turned over or rotated 180 degrees such that the back surface 204 of the left piece 282 and the front surface 202 of the right piece 283 are visible.

Assembly of left piece 282 and the right piece 283, as depicted in FIGS. 9 through 11, produces both an inside corner 294 and an outside corner 296 by simply reorienting the parts.

With the present invention, only one cut is required to produce the inside corners 294 and outside corners 296 without waste of material. In addition, as the same component part, namely the inside corner 294, is the same component as outside corner 296, only one SKU needs to be stocked by suppliers of the component parts 294, 296 to function as either an inside or outside pre-formed corner, making more efficient use of bin or shelf space and eliminating the scrapping of a substantial number of the outside corners produced—they can be used as inside corners.

Cutting and Installation of Lineal Crown Moulding of the Present Invention

The first steps involved in installing crown moulding in a room with mitred corners are the same whether using prior art flat back crown moulding or the lineal crown moulding of the present invention, namely:

1. Sketch the room you are about to crown. Start in a corner and work your way around the room in a clockwise direction, identifying each corner with a number.
2. Refer to a Crown Angle Chart for details on spring angle and wall coverage. Use the moulding's respective wall coverage measurement to mark its location on the wall.
3. Measure the length of each wall where you made your mark and transcribe the measurements to your plan.
4. Measure the angle of each corner with a protractor and copy the measurements to your plan The set up of the saw and cutting of the lineal crown moulding of the present invention to create the bevel and mitre cuts required in each corner of the room will vary depending on if you have a mitre saw or compound mitre saw. It may be necessary to use a compound mitre saw if the vertical stroke on the mitre saw is not high enough to accommodate the size of the lineal crown moulding being installed.

Figure 22:
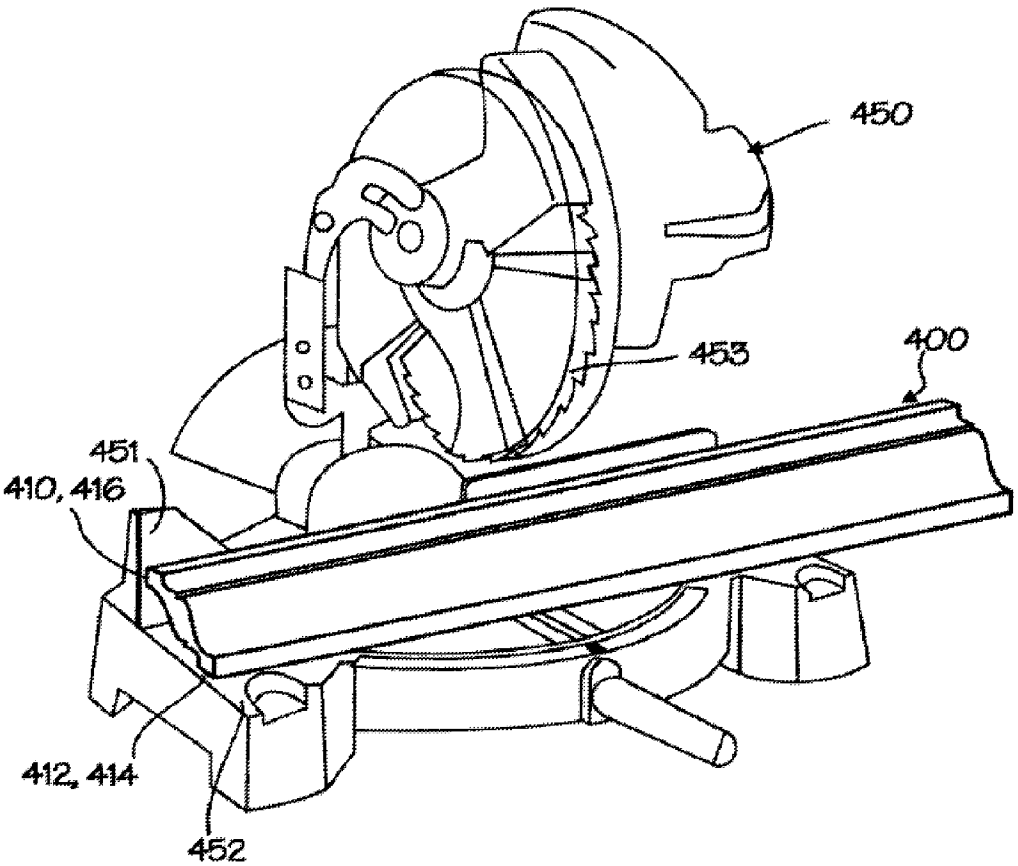
FIG. 22 is a perspective view of a piece of the lineal crown moulding of FIGS. 3-5, ready to be cut vertical nested on a mitre saw.
Figure 23:
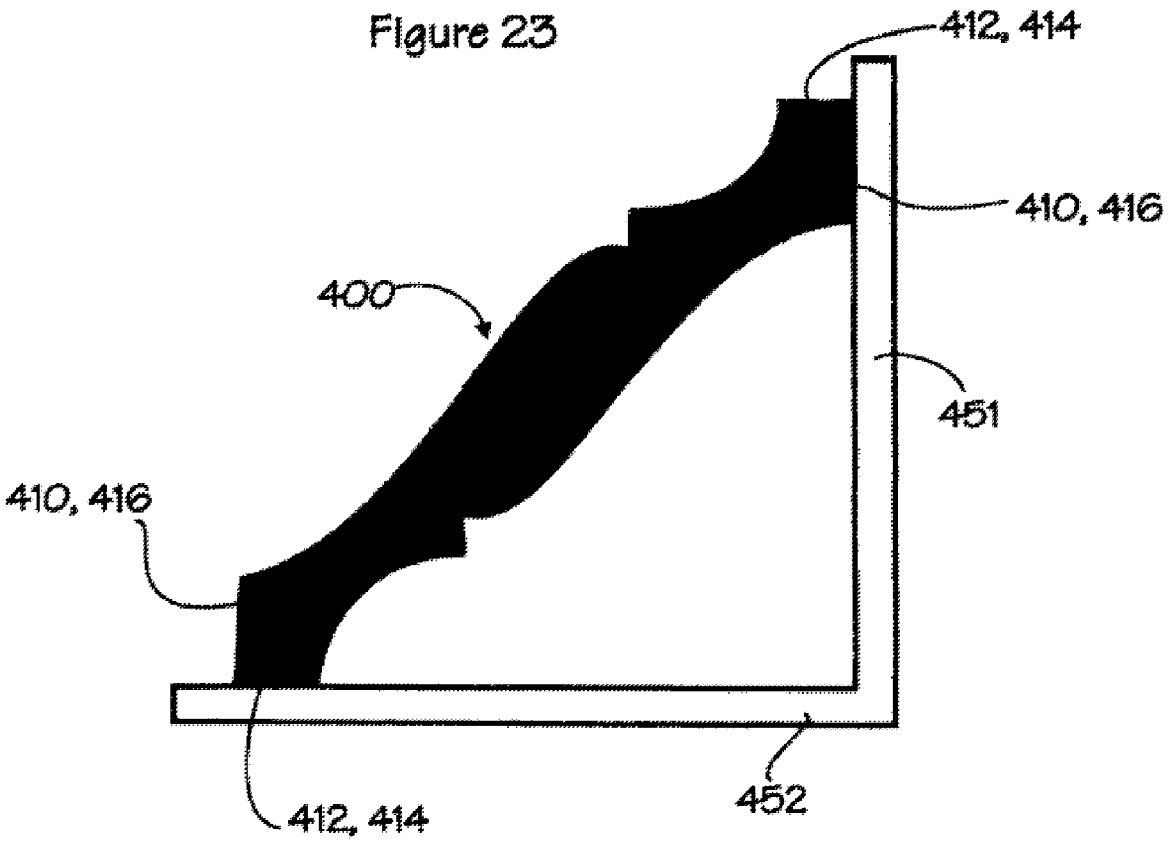
FIG. 23 is a schematic end plan view of the lineal crown moulding, saw table and saw fence of FIG. 22.

With a mitre saw (see FIGS. 22 and 23):

5. Adjust the saw 450 to cut half of the measured angle indicated on the plan. Note: Unless the angles of the other corners are different, there is no need to readjust the saw again. In the exemplified plan all the angles were 90 degrees so the saw is set to cut a mitre cut at 45 degrees.
6. Select a piece of lineal crown moulding 400 of the present invention longer than the length of the wall from corner 1 to corner 2. Place the lineal crown moulding 400 to the left of the saw blade 453 seated on the saw 450, as depicted in FIGS. 22 and 23, such that one of the chamfers 410, 416 that will form a wall seat against the fence 451 and the corresponding chamfer 412, 414 that will form the ceiling seat against the saw table 452. Note: if the wall is longer than the length of lineal moulding available it will be necessary to butt two or more pieces together to form the required length. The butt joint between pieces should be located where it is most esthetically appropriate and can be formed without adjusting the saw.
7. Cut as close as possible to the right end of the lineal crown moulding 400 to form the end that will fit in corner. The little piece to the right of the blade is scrap. Note whether you need inside corners or outside corners for your next cut. In the exemplified plan corner 2 is an inside corner.
8. Turn the moulding over if going from an outside corner to outside corner or inside corner to inside corner. In the exemplified plane corner 2 is an inside corner so the moulding is turned over. [If going from an outside corner to an inside corner or inside corner to outside corner: Do not turn the moulding over.] Slide the moulding to the right. Mark to required length. For an inside corner to an inside corner, measure from the longest point of the moulding to the length indicated on your plan. For an outside corner to an outside corner, measure from the shortest point of the moulding to the length indicated on your plan. If your next piece will be for an inside corner to an outside corner or an outside corner to an inside corner, measure from either (longest or shortest) point to the length indicated on your plan
9. Align the right side of the blade with the edge of your mark and cut to give you the moulding to extend from corners 1 to 2 with each end having the proper beveled and mitred cut. Repeat steps 6-9 until all of the pieces for each wall are cut. Note: If angles vary between different corners of the room, repeat step 2 before performing your cuts. If the length of moulding to the left of the saw after step 9 is sufficiently long to cover the wall between corners 2 and 3 it is not scrap. Repeat steps 8 and 9 to give you the moulding to extend from corners 2 to 3 with each end having the proper beveled and mitred cut.
10. You can either install the moulding as you go or if you are going to stain or paint the moulding before installation you can cut all the pieces first. To install, place the moulding to the wall along the appropriate wall.
11. Ensure both edges are flush against the wall and ceiling and that they align with your marks. Secure with finishing nails.

Figure 24:
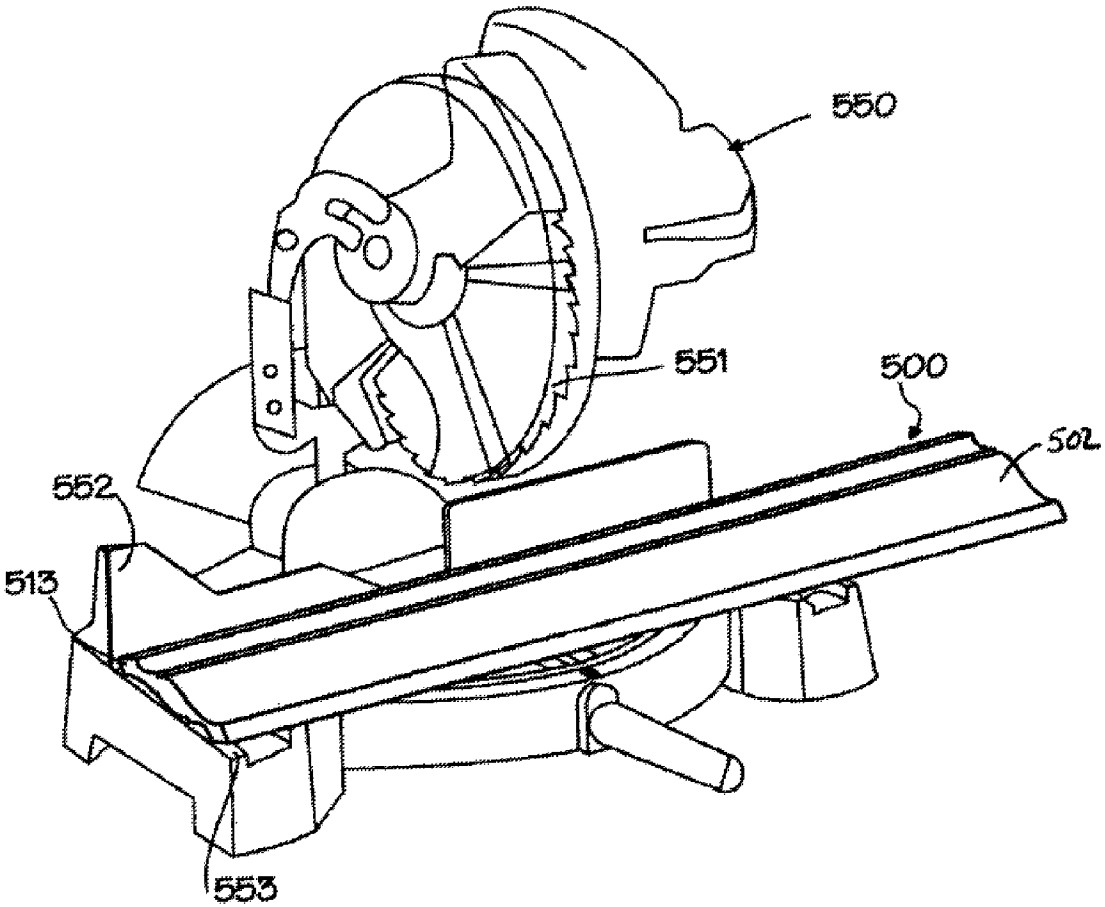
FIG. 24 is a perspective view of a piece of the lineal crown moulding of FIGS. 3-5, ready to be cut flat on a compound mitre saw.
Figure 25:
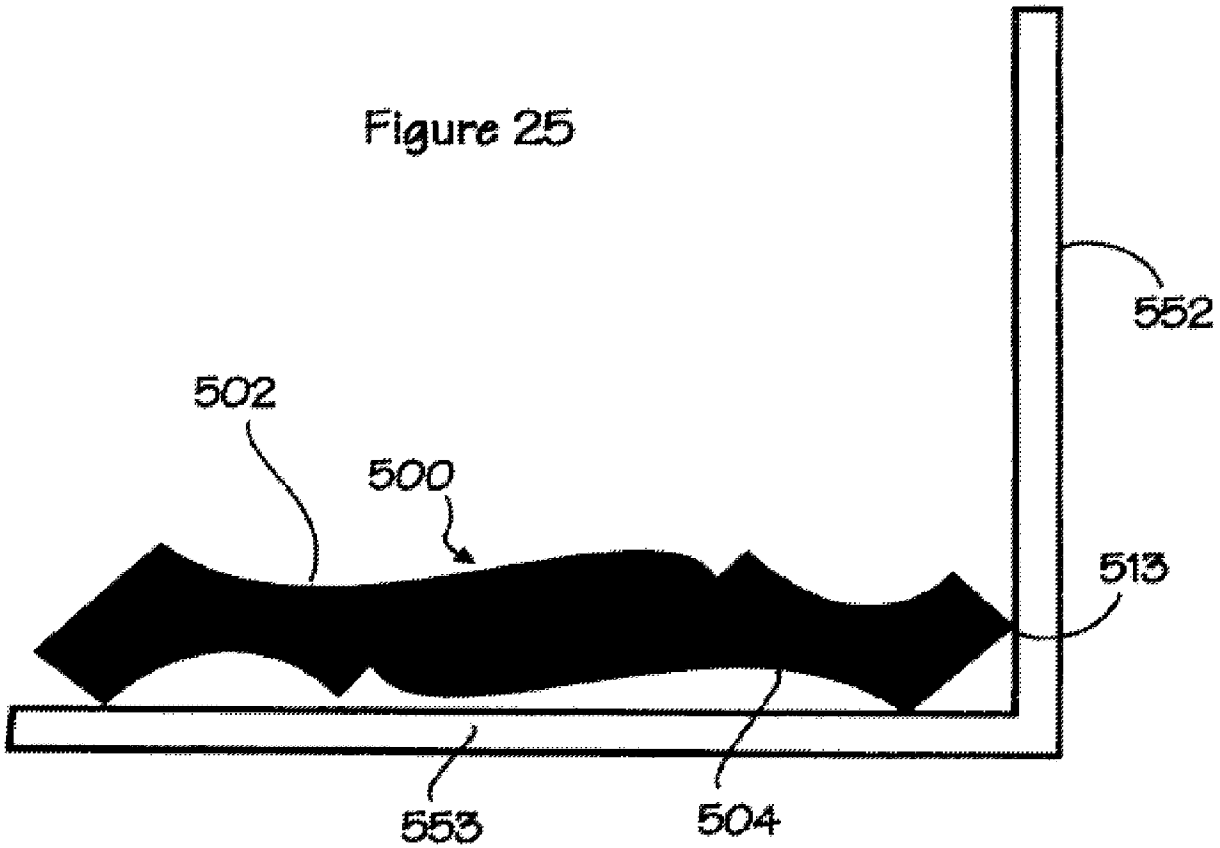
FIG. 25 is a schematic end plan view of the lineal crown moulding, saw table and saw fence of FIG. 24.

With a compound mitre saw (see FIGS. 24 and 25):

1. Refer to a Crown Angle Chart for mitre and bevel settings. Note: Unless the angles of your other corners are different, you won't need to readjust your saw again.
2. Select a piece of lineal crown moulding 500 of the present invention longer than the length of the wall from corner 1 to corner 2. The lineal crown moulding 500 is placed to the left of the saw blade 551 seated on the saw 550 as depicted in FIGS. 24 and 25 with an edge 513 against the fence 552 and the front or back surface 502, 504 flat on the saw table 553.
3. Cut as close as possible to the right end of the lineal crown moulding 500 to form the end that will fit in corner 1. Note whether you need inside corners or outside corners for your next cut. In the exemplified plan corner 2 is an inside corner.
4. Turn the moulding over if going from an outside corner to outside corner or inside corner to inside corner. If going from an outside corner to an inside corner or inside corner to outside corner: Do not turn the moulding over. Slide the moulding to the right. Mark to required length. For an inside corner to an inside corner, measure from the longest point of the moulding to the length indicated on your plan. For an outside corner to an outside corner, measure from the shortest point of the moulding to the length indicated on your plan. If your next piece will be for an inside corner to an outside corner or an outside corner to an inside corner, measure from either (longest or shortest) point to the length indicated on your plan.
5. Align the right side of the blade with the edge of your mark and cut to give you the moulding for corners 1 to 2 with each end having the proper beveled and mitred cut. Repeat steps 2-5 until all of the pieces for each wall are cut. Note: If angles vary between different corners of the room, repeat step 2 before performing your cuts. If the length of moulding to the left of the saw after step 5 is sufficiently long to cover the wall between corners 2 and 3 it is not scrap. Repeat steps 4 and 5 to give you the moulding to extend from corners 2 to 3 with each end having the proper beveled and mitred cut.
6. You can either install the moulding as you go or if you are going to stain or paint the moulding before installation you can cut all the pieces first. To install, place the moulding to the wall along the appropriate wall.

Figure 26:
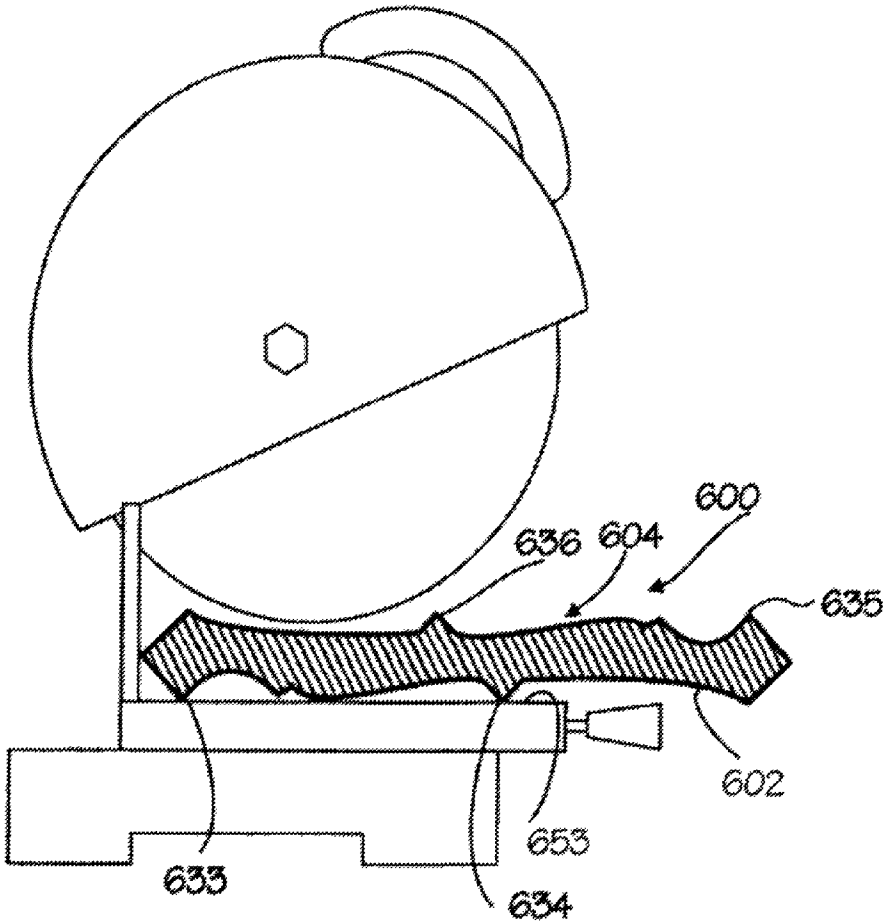
FIG. 26 is a schematic end plan view of another embodiment of lineal crown moulding according to the present invention, compound mitre saw table and saw fence where the height of the crown moulding is greater than the width of the saw table.

If the lineal crown moulding 600 is wider than the saw table 653 as illustrated schematically in FIG. 26 it is important in order to get the proper spring angle after cutting that the two outermost points 633, 634 on the front 602 and 635, 636 back surfaces 604 are spaced so they rest on the saw table 653. If not some form of table extension or jig may be required.

FIGS. 17 through 21, illustrate cross-sections of the profile of other embodiments of the lineal crown moulding of the present invention. In each case the lineal crown moulding has a front surface and a back surface having substantially identical configurations inverted relative to each other about a vertical centre line from a top side of said crown moulding to a bottom side of said crown moulding. Other sizes, profiles and materials of construction fall within the scope of the present invention.

In developing the front non-planar decorative profile portion and back non-planar decorative profile portion the design of the resulting lineal crown moulding, if using the same nominal thickness as for flat back crown moulding, standard profiles as shown in the Wood Moulding & Millwork Producers Association publications need to be modified. When developing the new non-planar decorative profiles for the lineal crown moulding of the present invention you should ensure that, when viewed in cross section, thin sections between the front non-planar decorative profile portion and back non-planar decorative profile portion have sufficient structural integrity and strength to be used in long lengths. For example for lineal crown moulding according to the present invention made from MDF the modulus of elasticity (MOE) and modulus of rupture (MOR) at the center of the crown moulding should be optimized for example by increasing the amount of resin to fiber, utilizing more refined fiber or changing the press cycle.

Figure 18:
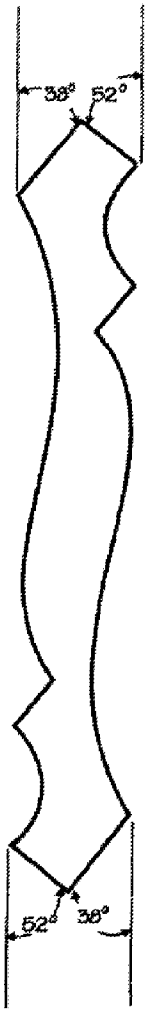
FIG. 18 is an end plan view of another embodiment of a lineal crown moulding according to the present invention.
Figure 17:
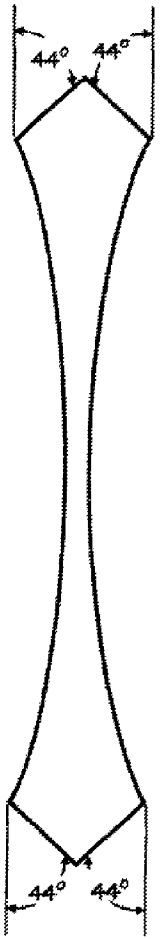
FIG. 17 is an end plan view of another embodiment of a lineal crown moulding according to the present invention.
Figure 21:
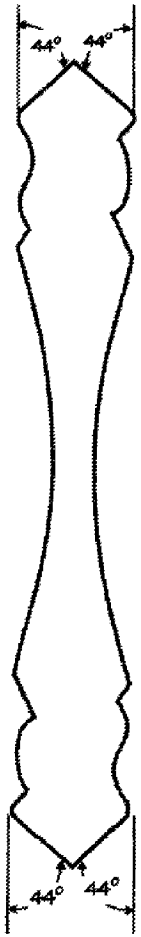
FIG. 21 is an end plan view of another embodiment of a lineal crown moulding according to the present invention.
Figure 20:
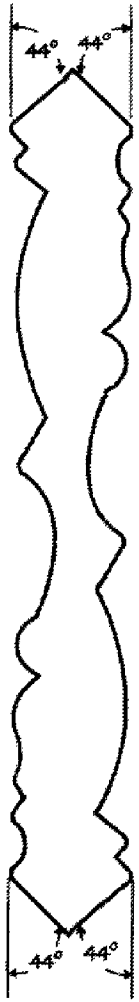
FIG. 20 is an end plan view of another embodiment of a lineal crown moulding according to the present invention.
Figure 19:
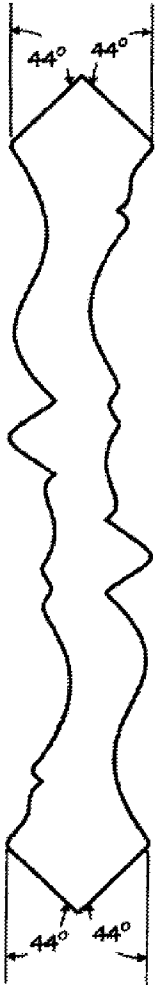
FIG. 19 is an end plan view of another embodiment of a lineal crown moulding according to the present invention.

In FIGS. 17, 19-21 the angle of the chamfers is shown as 44 degrees as opposed to 45 degrees in order to accommodate slight imperfections in the wall or ceiling. FIG. 18 shows angles of 52 degrees for the top front chamfer and bottom back chamfer and 38 degrees for the bottom front chamfer and top back chamfer.

The lineal crown moulding of the present invention:

(a) Cut frustration. Simply turn the moulding over and cut using the same saw angle because both sides of the present invention have a matching decorative profile.

(b) Cut time. All corners (inside and outside) can be cut without repositioning the saw.

(c) Cut Waste. Since the saw stays locked in the same position for all your cuts, you make fewer mistakes when cutting.

(d) The present invention makes installing crown moulding quick, easy and economical.

Having illustrated and described embodiments of the invention and certain possible modifications thereto, it should be apparent to those of ordinary skill in the art that the invention permits of further modification in arrangement and detail. All such modifications are covered by the scope of the invention.

What is claimed is:

1. An elongated lineal crown moulding comprising:

a front surface with:

a top front chamfer portion;

a bottom front chamfer portion; and a front non-planar decorative profile portion separating the top front chamfer portion and the bottom front chamfer portion; and a back surface with:

a top back chamfer portion, the top back chamfer portion and the top front chamfer portion disposed in a substantially 90 degree relationship to each other and merging in a direction toward an upper outermost point of the crown moulding;

a bottom back chamfer portion, the bottom back chamfer portion and the bottom front chamfer portion disposed in a substantially 90 degree relationship to each other and each merging in a direction toward a lower outermost point of the crown moulding; and a back non-planar decorative profile portion separating the top back chamfer portion and the bottom back chamfer portion, the back non-planar decorative profile portion oriented as an inversely mirrored version of the front non-planar decorative profile portion.

2. The elongated crown moulding according to claim 1, wherein:

the back surface is an inversely mirrored version of the front surface.

3. The elongated crown moulding according to claim 1, wherein:

the top front chamfer portion and the bottom back chamfer portion define planes that are substantially parallel to one another.

4. The elongated crown moulding according to claim 1, wherein:

the top front chamfer portion and the bottom back chamfer portion are proportionately of a same size.

5. The elongated crown moulding according to claim 1, wherein:

the back non-planar decorative profile portion has a substantially identical contour of the front non-planar decorative profile portion.

6. The elongated crown moulding according to claim 1, wherein:

the back non-planar decorative profile portion and the front non-planar profile portion are inversely mirrored versions of each other with respect to a longitudinal centre line.

7. The elongated crown moulding according to claim 6, wherein:

the longitudinal centre line is defined by an edge located on at least one of the top front chamfer portion and the top back chamfer portion of the elongated moulding and an edge located on at least one of the bottom front chamfer portion and the bottom back chamfer portion of the elongated moulding, the longitudinal centre line passing through a cross-sectional centroid of the moulding.

8. The elongated crown moulding according to claim 1, wherein:

the elongated crown moulding is of a single piece of homogenous material.

9. An elongated lineal crown moulding comprising:

a front surface with a top front chamfer portion having a first flat structure-contacting surface, a bottom front chamfer portion having a second flat structure-contacting surface, and a front non-planar decorative profile portion separating the top front chamfer portion and the bottom front chamfer portion; and a back surface with a top back chamfer portion having a first flat structure-contacting surface, a bottom back chamfer portion having a second flat structure-contacting surface, and a back non-planar decorative profile portion separating the top back chamfer portion and the bottom back chamfer portion, the back non-planar decorative profile portion being a substantially identical and inversely symmetrical version of the front non-planar decorative profile portion, the first flat structure-contacting surface of the top front chamfer portion and the first flat structure-contacting surface of the top back chamfer portion disposed in a substantially 90 degree relationship to each other, the second flat structure-contacting surface of the bottom front chamfer portion and second flat structure-contacting surface of the bottom back chamfer portion disposed in a substantially 90 degree relationship to each other.

10. The elongated crown moulding according to claim 9, wherein:

the back surface is inversely symmetrical to the front surface.

11. The elongated crown moulding according to claim 9, wherein:

the top front chamfer portion and the bottom back chamfer portion define planes that are substantially parallel to one another.

12. The elongated crown moulding according to claim 9, wherein:

the top front chamfer portion and the bottom back chamfer portion are proportionately of a same size.

13. The elongated crown moulding according to claim 9, wherein:

the back non-planar decorative profile portion and the front non-planar profile portion are inversely symmetrical versions of each other with respect to a longitudinal centre line.

14. The elongated crown moulding according to claim 13, wherein:

the longitudinal centre line is defined by an edge located on at least one of the top front chamfer portion and the top back chamfer portion of the elongated moulding and an edge located on at least one of the bottom front chamfer portion and the bottom back chamfer portion of the elongated moulding, the longitudinal centre line passing through a cross-sectional centroid of the moulding.

15. The elongated moulding according to claim 9, wherein:

the elongated crown moulding is lineal and of a single piece of material.

16. A decorative building structure comprising:

a building having a ceiling and a wall;

an elongated moulding having:

a front surface with a top front chamfer portion, a bottom front chamfer portion, and a front non-planar decorative profile portion disposed between the top front chamfer portion and the bottom front chamfer portion; and a back surface with a top back chamfer portion, a bottom back chamfer portion, and a back non-planar decorative profile portion disposed between the top back chamfer portion and the bottom back chamfer portion;

a first position of the elongated moulding with the top back chamfer portion adjacent to and flush with the ceiling and the bottom back chamfer portion adjacent to and flush with the wall, the first position only exposing the front non-planar decorative profile portion; and a second position of the elongated moulding, rotated with respect to the first position, such that the top front chamfer portion is adjacent to and flush with the wall and the bottom front chamfer portion is adjacent to and flush with the ceiling and only exposing the back non-planar decorative profile portion that has the same appearance and orientation as the profile of the front non-planar decorative profile portion when in the first position.

17. The decorative building structure according to claim 16, wherein:

the top front chamfer portion and the bottom back chamfer portion define planes that are substantially parallel to one another.

18. The decorative building structure according to claim 16, wherein:

the top front chamfer portion and the bottom back chamfer portion are proportionately of a same size.

19. The decorative building structure according to claim 16, wherein:

the back non-planar decorative profile portion, when in the first position, has a substantially identical contour of the front non-planar decorative profile portion, when in the second position, that is inversely symmetrical.

20. The decorative building structure according to claim 19, wherein:

the back non-planar decorative profile portion is symmetrical with respect to a vertical centre line, the vertical centre line defined by an edge located on at least one of the top front chamfer portion and the top back chamfer portion of the elongated moulding, an edge located on at least one of the bottom front chamfer portion and the bottom back chamfer portion of the elongated moulding, and a centroid located within a cross section of the moulding.

* * * * *